United States Patent [19]

King

[11] 4,094,227

[45] June 13, 1978

[54] FLUID MOTOR

[76] Inventor: Samuel A. King, P.O. Box 6, Alturas, Fla. 33820

[21] Appl. No.: 803,934

[22] Filed: Jun. 6, 1977

[51] Int. Cl.[2] ..... F01L 33/02; F01B 7/04

[52] U.S. Cl. ..... 91/180; 91/181; 92/69 R; 92/149

[58] Field of Search ..... 91/180, 181; 92/69 R, 92/149

[56] References Cited

U.S. PATENT DOCUMENTS

| | | | |
|---|---|---|---|
| 847,490 | 3/1907 | Monroe | 91/180 |
| 1,083,686 | 1/1914 | Kuhn | 91/180 |
| 1,406,319 | 2/1922 | Wygodsky | 91/181 |
| 1,458,922 | 6/1923 | Rivera | 91/181 |
| 2,329,480 | 7/1941 | Neuland | 92/69 R |

*Primary Examiner*—Paul E. Maslousky

[57] ABSTRACT

An opposed piston fluid motor having a pair of angularly related cylinders rigidly joined at adjacent ends in a common plane is mounted above a base with the common plane normal to the base and the cylinders inclined downwardly from the common plane toward the base in the manner of an inverted V. A crankshaft is rotatably supported above the base with its axis parallel to the base and lying in the common plane below the cylinders. A piston is reciprocably mounted in each cylinder, and an expansible working chamber is provided within the cylinders between the pistons. Working fluid is supplied to the working chamber through a fluid port located at the apex of the cylinders under the control of a rotary motor control valve driven by the crankshaft. The crankshaft has a pair of cranks which are displaced 180° apart. Each piston is connected to a different one of the cranks by a piston rod and a connecting rod. The piston rod has one end pivotally connected to the piston by a transverse pivot pin and an outer end which is pivotally connected to one end of the connecting rod by a pivot pin which is supported at one end of an oscillating arm which is pivotally supported from the base.

3 Claims, 5 Drawing Figures

FLUID MOTOR

BACKGROUND OF THE INVENTION

1. Field of the Invention

The invention relates to an opposed piston fluid motor and particularly to an arrangement for mounting same and to improved means for converting the reciprocating motion of the pistons to rotary motion of a crankshaft.

2. Description of the Prior Art

Opposed piston fluid motors and engines are well known but they all involve the problem of converting the reciprocating motion of the pistons to the rotary motion of a crankshaft in an efficient and economical manner.

Patents illustrative of the prior art are:

| | | |
|---|---|---|
| 393,037 | Smith | Nov. 20, 1888 |
| 787,961 | Temple | Apr. 25, 1905 |
| 1,383,367 | Wygodsky | July 5, 1921 |
| 1,406,319 | Wygodsky | Feb. 14, 1922 |
| 1,458,922 | Rivera | June 12, 1923 |
| 2,507,923 | Morris | May 16, 1950 |
| 2,809,614 | Prescott | Oct. 15, 1957 |
| 3,130,592 | Burrison | Apr. 28, 1964 |
| 3,369,733 | Campbell | Feb. 20, 1968 |

The present invention distinguishes from all of the opposed piston fluid motors and engines disclosed in the above enumerated patents in the manner of mounting the cylinders above a supporting base and in the manner of supporting the pivot pins connecting the piston rods with connecting rods which connect the piston rods with separate cranks on a crankshaft supported above and parallel to the base and beneath the motor cylinders. The pivot pins are supported on the ends of oscillating arms which are pivotally supported on the supporting base and thus the pivot pins oscillate back and forth in a circular arc.

SUMMARY OF THE INVENTION

It is an object of the invention to provide an opposed piston fluid motor having improved support and motion converting means.

It is another object of this invention to provide an opposed piston fluid motor having angularly related cylinders which are joined at adjacent ends and which are supported above a base by a supporting frame with the cylinders inclined outwardly and downwardly in opposite directions from a common plane containing the adjacent ends of the cylinders, a crankshaft rotatably supported above the base and beneath the cylinders with its axis parallel to the base and lying in the aforesaid common plane, pistons reciprocatably mounted within the cylinders and forming between them within the confines of the cylinders a working chamber, piston rods pivotally connected to the pistons and extending outwardly of the cylinders, connecting rods pivotally connected to the outer ends of the piston rods and to separate cranks oppositely disposed on the crankshaft and oscillating arms each pivotally supported on the base at one end and supporting on its other end a pivot pin connecting one of the piston rods and one of the connecting rods.

BRIEF DESCRIPTION OF THE DRAWINGS

With the foregoing more important objects and features in view and such other objects and features which may become apparent as this specification proceeds, the invention will be understood from the following description taken in conjunction with the accompanying drawings, in which like characters of reference are used to designate like parts, and in which.

DETAILED DESCRIPTION OF THE PREFERRED EMBODIMENT

Figure 1:
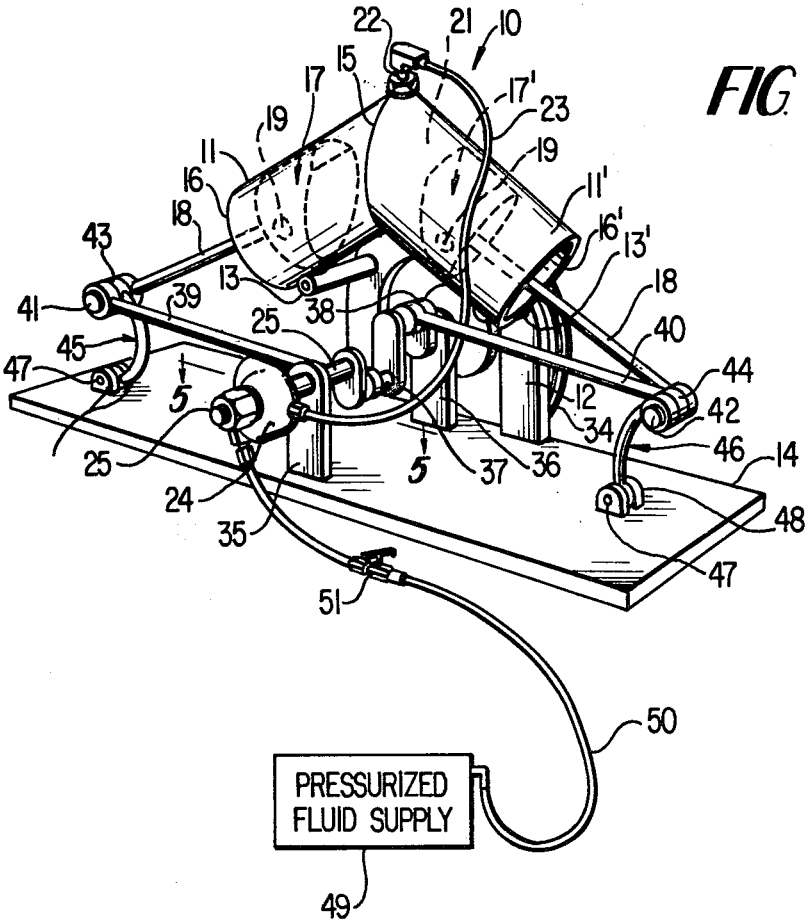
FIG. 1 is a perspective view of the fluid motor of this invention.
Figure 2:
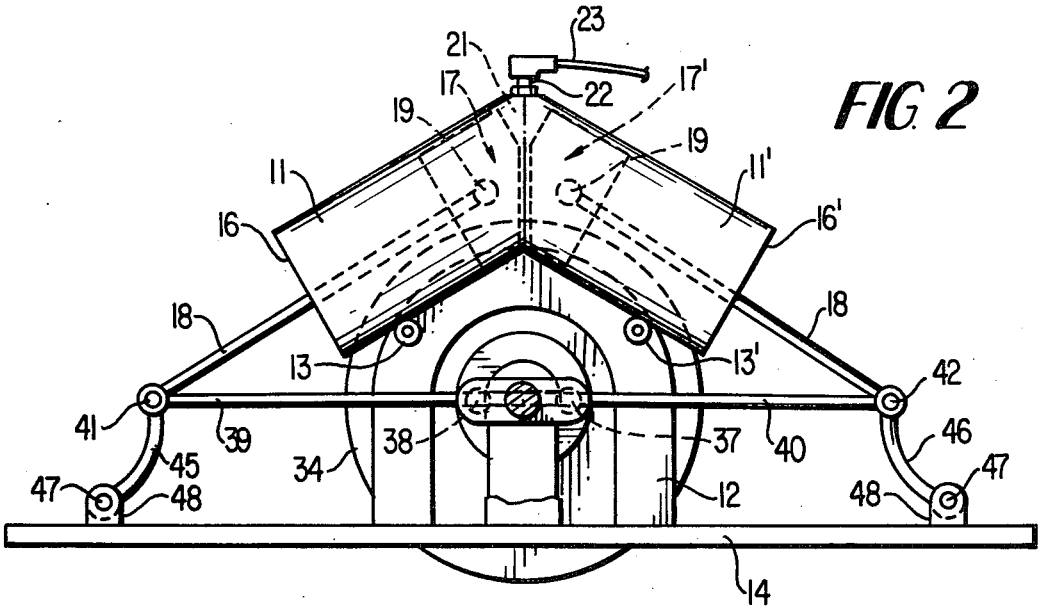
FIG. 2 is a front elevational view of the fluid motor shown in FIG. 1 showing the opposed pistons in their closest position at the beginning of a working stroke.
Figure 3:
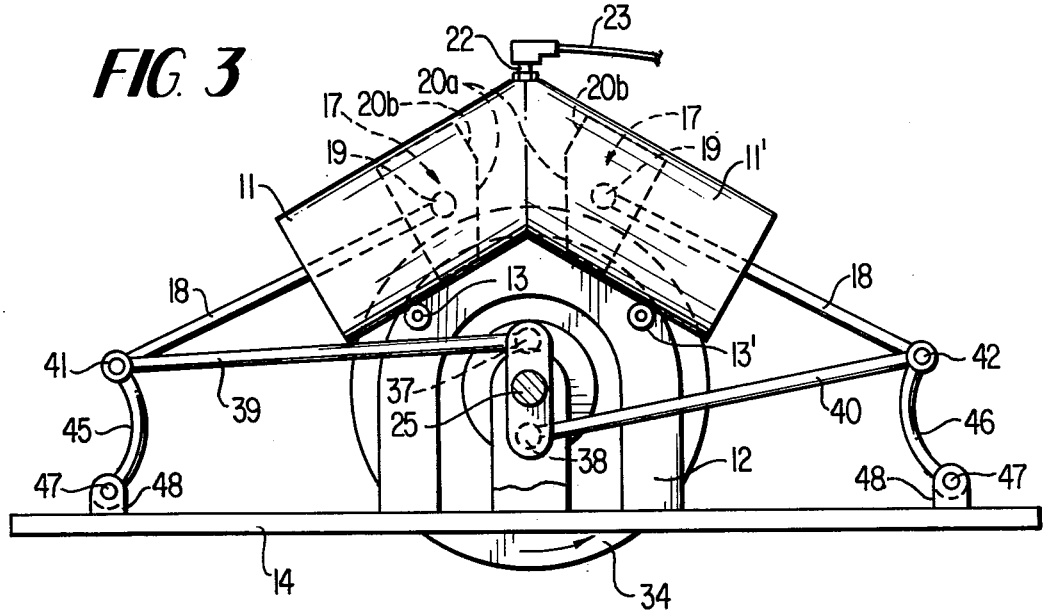
FIG. 3 is a front elevational view similar to FIG. 2 but showing the pistons midway through a working stroke.

Referring now to the drawings and particularly to FIG. 1, the improved fluid motor of this invention is indicated generally by the numeral 10. It comprises a pair of rigidly joined angularly related cylinders 11,11' supported from an upstanding U-shaped frame 12 by support rods 13,13' projecting laterally from the frame 12 and rigidly attached thereto, the rods being welded or otherwise secured to the underside of the cylinders 11,11' so that the longitudinal axis of the cylinders form an inverted V lying in a vertical plane. The support frame 12 is supported on a planar base 14. The cylinders 11,11' are rigidly joined at their adjacent ends in a common plane of junction 15 which is oblique to the axis of the respective cylinders. The opposite ends 16,16' of the cylinders 11,11' are generally perpendicular to the longitudinal axis of the respective cylinders. A pair of pistons 17,17' are reciprocably mounted within the cylinders 11,11' and each has a piston rod 18 connected thereto by a transverse piston pin 19. The pistons 17,17' each have a working face comprising a major lower surface **20*a* which is accute to the axis of the piston and a minor upper surface 20*b* which is perpendicular to the axis of the piston. The major lower surfaces 20*a*,20*a* of the two pistons are always parallel to each other as the pistons reciprocate within the cylinders 11,11'. Between the working faces of the pistons 17,17' is an expansible working chamber 21 which increases in size as the pistons move apart and decreases in size as the pistons approach each other. The minor upper surfaces of the piston's working faces diverge upwardly with respect to each other and provide between them a small working chamber when the pistons are moved inwardly to a position where the major face portions 20*a*,20*a* approximately abut each other with a minimum of clearance as shown in FIG. 2. A fluid port 22 is provided at the apex of the juncture between the cylinders 11,11' which communicates with the working chamber 21. A fluid conduit 23 connects the fluid port 22 with a fluid control valve means 24 for cyclically admitting pressurized fluid to the expansible working chamber 21** and exhausting fluid from the expansible working chamber.

Figure 4:
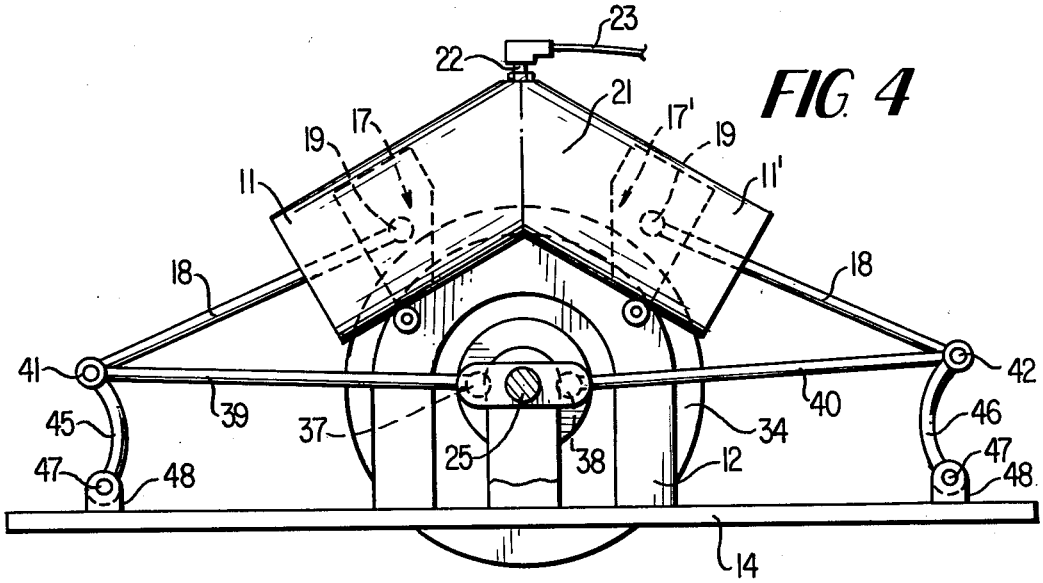
FIG. 4 is a view similar to FIG. 2 but showing the pistons at the end of a working stroke.
Figure 5:
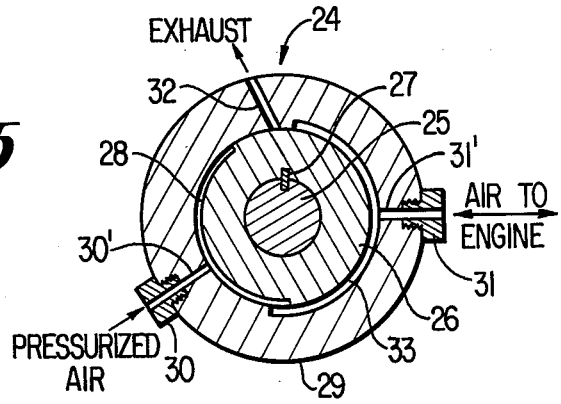
FIG. 5 is a cross sectional view taken on line 5—5 of FIG. 1 through the fluid control valve which controls the working fluid flow to and from the motor of this invention.

The fluid control valve means 24 is mounted on one end of a crankshaft 25 and secured there by means of a nut 25'. As seen in FIG. 5, it includes a rotor in the form of a bushing or sleeve 26 which is keyed to the crankshaft 25 by a key 27 and a valve housing 29, having a cylindrical bore or valve chamber 29' in which the rotor 26 is rotatably mounted. Pressurized fluid, such as air, is supplied to the control valve means 24 from a suitable supply indicated by the block 49 through a conduit 50 in which a manual valve cock 51 is located and fluid supply fitting 30 attached to the housing 29. The fluid supply fitting 30 has a port 30' communicating with the cylindrical valve chamber 29'. A fluid conduit fitting 31 is attached to the valve housing 29 and is connected to the fluid conduit 23 which conveys fluid to and from the cylinder port 22. The fitting 31 communicates with a fluid passage 31' through the valve housing which opens inwardly into a circular groove 33 cut in the face of the valve housing bore 29'. The groove 33 extends partially around the face of the bore 29' but stops short of the fluid supply port 30' adjacent one end and an exhaust port 32 adjacent the other end of the groove. The exhaust port 32 extends through the valve housing 29 to provide an exhaust passage from the valve chamber 29' to the atmosphere outside of the valve housing. The rotor 26 also has a groove 28 cut in its outer periphery, the groove being a sector of a circle of almost 180 degrees. The groove 28 in the rotor is positioned at the same axial distance through the valve bore 29' as the groove 33 in the valve housing so that the grooves 28 and 33 will overlap during the rotation of the rotor 26. When the groove 28 overlaps, the groove 33 and the fluid supply port 30', fluid is supplied through the grooves 28 and 33 to the fluid passage 31' which supplies fluid to the cylinder port 22. As soon as the trailing end of the rotor groove 28 passes the fluid supply port 30', the supply of pressurized air to the motor cylinders will be discontinued. As soon as the leading end of the rotor groove 28 reaches the exhaust port 32, fluid from the motor cylinders will exhaust through the cylinder port 22, fluid conduit 23, fitting 31, passage 31', groove 33, groove 28 and exhaust port 32. The fluid motor 10 is single acting, therefore working fluid is supplied to the working chamber 21 only during one-half cycle. In order to turn the crankshaft during the second half cycle and to return the pistons 11,11' from the end of their working stroke as shown in FIG. 4, to the beginning of the working stroke as shown in FIG. 2, a fly wheel 34 is affixed on one end of the crankshaft 25, which continues to turn the crankshaft during the second half cycle because of the inertia of the fly wheel. A pulley may be attached to the fly wheel 25 as a means of transmitting a useful work to a utility device (not shown).

The crankshaft 25 is rotatably supported above the base 14 by a pair of upstanding bearing support posts 35,36 affixed to the base 14. The axis of the crankshaft 25 is parallel to the base 14, and it lies in the same common plane 15 in which the adjacent ends of the cylinders 11,11' lie. The crankshaft includes a pair of cranks 37,38 which are displaced 180 degrees from each other.

A connecting rod 39 connects the crank 37 with the piston rod 18 extending from piston 17 and a connecting rod 40 connects the crank 38 with the piston rod 18 extending from piston 17'. The connecting rods 39 and 40 are pivotally connected to the cranks 27 and 38 respectively at their one end and to pivot pins 41 and 42 respectively at their opposite ends. The pivot pins 41 and 42 are rotatably supported at the upstanding ends 43 and 44 respectively of oscillating arms 45 and 46 with the axis of each pin parallel to the axis of the crankshaft 25. The oscillating arms 45 and 46 are pivotally supported upon the base 14 on opposite sides of the crankshaft 25 at equal distances therefrom by pivot pins 47,47 each extending through a pair of upstanding pivot blocks 48,48 fixed on the base 14. The ends of the oscillating arms 45 and 46 are formed as parallel sleeves for pivotal connection with pivot pins. Similarly the connecting rods 39 and 40 have parallel sleeves on opposite ends for connection with cranks 37,38 respectively and with the pivot pins 41,42 respectively. The piston rod 18 extending from the piston 17, and the piston rod 18 extending from piston 17' each have sleeves formed on their outer ends which receive the pivot pins 41 and 42 respectively. It is thus apparent that the oscillating arms 45 and 46 provide support for the pivot pins 41 and 42 respectively which in turn provide pivotal connections between the piston rods 18 of the respective pistons 17,17' and the connecting rods 39 and 40.

In operation, the motor 10 is started by opening the valve cock 51 to admit pressurized working fluid from the fluid supply 49 to the fluid control valve means 24, and the fly wheen 25 is turned by hand until the groove 28 in the valve rotor 26 is positioned to span the fluid inlet passage 30' and the groove 33 in the valve housing. Working fluid is then admitted to the working chamber 21 where it expands and pushes the pistons 11,11' apart. The outwardly directed motion of the pistons 11,11' is transmitted by the piston rods 18,18 and connecting rods 39, and 40 to the cranks 37 nd 38, thus turning the crankshaft 25. The energy stored in the fly wheel 34 during the working stroke of the pistons 11,11' will cause the fly wheel to continue to turn during the second half cycle of the fluid motor 10 and position the pistons 11 and 11' and the valve rotor 26 to begin another working stroke.

The motor is stopped by closing the valve cock 51 to cut off the supply of working fluid to the motor and allowing the load on the crankshaft to stop the rotation thereof. If desired, a brake (not shown) may be provided to engage the fly wheel and stop rotation thereof as soon as the valve cock 51 is closed.

While in the foregoing there has been described and shown a preferred embodiment of the invention, various modifications and equivalents may be resorted to within the spirit and scope of the invention as claimed.

What is claimed is:

1. An opposed piston fluid motor comprising a pair of angularly related cylinders having adjacent ends rigidly joined in a common plane oblique to the axis of each cylinder and remote open ends, a base, means mounting said pair of cylinders spaced above said base with said common plane in which the adjacent ends of the cylinders lie perpendicular to the base, and with the cylinders inclined downwardly from said common plane toward said base in the manner of an inverted V, a pair of pistons, there being a different one of said pistons reciprocably mounted in each of said cylinders, a separate piston rod for each piston, each of said piston rods extending outwardly through the open end of a cylinder and having an inner end pivotally connected to one of the pistons and an outer end located outside of the cylinder in which the piston reciprocates, a pair of oscillating arms, each arm having one end pivotally supported from said base and another end pivotally connected to the outer end of one of the piston rods, means mounting each of said oscillating arm to oscillate about an axis parallel to said common plane and in a plane normal to said common plane, a crank shaft, means rotatably mounting said crankshaft above said base to rotate about an axis parallel to said base and lying in said common plane, said crankshaft having a pair of axially displaced cranks, angularly displaced 180° from each other, a pair of connecting rods having opposite ends, one of said connecting rods having one end pivotally connected to one of said cranks and an opposite end pivotally connected to the pivot connection between one of said piston rods and one of the oscillating arms, the other connecting rod having one end pivotally connected to the other of said cranks and having an opposite end pivotally connected to the pivot connection between the other of said piston rods and the other of said oscillating arms, a fly wheel mounted on said crankshaft to rotate therewith, said pistons each having a working face, the working faces of said pair of pistons facing each other within said cylinders, an expansible working chamber within said cylinders between the working faces of the pistons, a fluid port communicating with said expansible working chamber at the adjacent ends of said cylinders, a fluid control valve means for cylically admitting pressurized fluid to said expansible working chamber and exhausting exhaust fluid from said expansible working chamber, and fluid conduit means connecting said fluid control valve means with said fluid port, said control valve means being operatively connected to said crankshaft.

2. The fluid motor according to claim 1 wherein the working face of each of said pistons comprises a lower major surface portion and an upper minor surface portion, said major surface portions of the pair of pistons being parallel to each other and to the common plane including said adjacent cylinder ends, the minor surface portion of each piston being normal to the axis of the piston and cylinder in which the piston reciprocates, the throw of said cranks, the lengths of said piston rods and of said oscillating arms being selected so that the pistons will have maximum inward travel to a position wherein the major surface portions of the pistons approximately abut each other with slight clearance between them.

3. The fluid motor according to claim 1 wherein said means mounting said pair of cylinders comprises an upstanding frame normal to said base and rigidly secured thereto, said frame having laterally extending projections underlying said cylinders to which said cylinders are rigidly secured.

* * * * *